US005878738A

United States Patent [19]

Poirier

[11] Patent Number: 5,878,738

[45] Date of Patent: Mar. 9, 1999

[54] DISPOSABLE DEVICE FOR THE INTERNAL PROTECTION OF DOMESTIC OVENS

[76] Inventor: Christian Poirier, Hameau de la Châlière, Chemin du Belvédère, F-06160 Juans Les Pins, France

[21] Appl. No.: 860,011

[22] PCT Filed: Dec. 21, 1995

[86] PCT No.: PCT/FR95/01705

§ 371 Date: Jun. 19, 1997

§ 102(e) Date: Jun. 19, 1997

[87] PCT Pub. No.: WO96/20374

PCT Pub. Date: Jul. 4, 1996

[30] Foreign Application Priority Data

Dec. 23, 1994 [FR] France ..... 94/15904

[51] Int. Cl.[6] ..... A21B 1/00

[52] U.S. Cl. ..... 126/19 R; 126/39 M; 126/273 R

[58] Field of Search ..... 126/19 R, 273 R, 126/39 M

[56] References Cited

U.S. PATENT DOCUMENTS

| | | | |
|---|---|---|---|
| 3,036,192 | 5/1962 | Fry . | |
| 3,151,608 | 10/1964 | Hurko | 126/19 R |
| 3,159,156 | 12/1964 | Incledon . | |
| 3,192,917 | 7/1965 | Baert . | |
| 3,207,148 | 9/1965 | Marinace | 126/19 R |
| 4,778,968 | 10/1988 | Torres | 126/39 M |

FOREIGN PATENT DOCUMENTS

| | | |
|---|---|---|
| 492435 | 7/1971 | Switzerland . |
| 1222341 | 2/1971 | United Kingdom . |

*Primary Examiner*—Carroll B. Dority
*Attorney, Agent, or Firm*—Young & Thompson

[57] ABSTRACT

A device for the internal protection of domestic ovens comprised of a folding box. The box (3) has four walls, that is a bottom wall, two side walls (5 and 6) and the rear wall (7), and a non-spill flange (8) which forms the lower part of the front wall. Preferably the invention applies to electric household appliances.

14 Claims, 7 Drawing Sheets

DISPOSABLE DEVICE FOR THE INTERNAL PROTECTION OF DOMESTIC OVENS

FIELD OF THE INVENTION

The present invention relates to a disposable device for protecting the interior of domestic ovens from encrustations due to projections of grease and sauce.

BACKGROUND OF THE INVENTION

Dealing with the interior of domestic ovens remains a major problem in most kitchens, despite certain devices used by manufacturers, such as cleaning by pyrolysis which requires a considerable expenditure of energy, catalytic elements on the walls, which rapidly deteriorate, or for conventional ovens, the use of chemical degreasing agents with numerous drawbacks; progressive damage to the walls due to corrosion arising from acids, the risk of burns and intoxication, bad odors, etc.

The state of the art can be defined by the following documents.

Swiss CH-A-477.195 provides an electric rotisserie which comprises disposable metallic sheets covering the side walls with permanent magnets.

The provided protection is highly insufficiently because only the side walls of the oven are protected. The bottom of the oven, which is the least accessible, or at the lower level, where the cooking liquids collect, the walls are absent and only insufficiently partially protect the oven. Moreover, the use of magnets for the securement is both costly and not to be recommended in an oven for cooking foodstuffs, all the more so when heating is by electrical resistance, which can give rise to parasitic currents of magnetic origin.

U.S. Pat. No. 1,158,782 and Belgian 904.275 relate to devices for the internal protection of ovens. These latter, contrary to the above document in the prior art, provide devices each having a parallelepipedal shape, whose front wall has been eliminated to permit the insertion of foodstuffs into the oven with each protective device, itself being inserted in the oven.

The protection is very good with these protective devices; nevertheless, too great a confinement of the food-stuffs can lead to bad cooking of the latter.

SUMMARY OF THE INVENTION

The present invention removes the necessary to choose between good protection of the oven or good cooking of the food.

To this end, the invention relates to a disposable device for the internal protection of domestic ovens constituted by a bendable housing, characterized by the fact that the housing is constituted by four walls, which is to say a lower wall, two side walls and a rear wall, and a non-spill flange which constitutes the lower portion of a front wall.

In a first embodiment, the housing is of a single piece.

In a second embodiment, the housing is in two parts, a first part constituting the two lateral walls and the rear wall, and a second part constituting the lower wall and the non-spill flange.

According to this second embodiment, the second portion is constituted by a tray, whose bottom serves as the lower wall, and of which one of the edges serves as the non-spill flange.

Moreover, the first portion is constituted by three walls secured to each other.

No matter what the embodiment, the housing and hence the walls are constituted by aluminum sheets.

On the one hand, the housing and hence the walls are constituted of cloth and/or paper. On the other hand, each wall comprises a core constituted by a frame.

The lateral walls comprise horizontal grooves, each groove of one of the walls being at the same level as a groove of another wall, such that at least one of the grills of the oven can be emplaced in the grooves.

The rear wall comprises holes for the passage of air by convection.

Each hole gives on an H-shaped cutout, which creates two ribs whose deformations constitute an air projection nozzle.

The device comprises three convective air inlets, from above the rear plate, from the front, which is to say from above the non-spill flange, and through the holes of the rear wall, and also comprises at least one air aspiration means.

The aspiration of the air is ensured by a grill-filter present at the level of the rear wall.

According to a modification, the grill-filter comprises a grill with overhangs, which prevents the liquids from running down the external surface of the rear wall.

The housing comprises at least one slot for the passage of the rod of a spit.

All or a portion of at least one of the walls, disposed at the level of the internal illumination of the oven, is of transparent structure and heat proof.

A transparent front wall is present such that a free space between this wall and the non-spill flange exists to permit the circulation of air.

The non-spill flange is of V shape, in transverse cross section.

BRIEF DESCRIPTION OF THE DRAWINGS

The accompanying drawings are given by way of indicative but non-limiting examples. They represent different embodiments according to the invention. They permit easy comprehension of the invention.

Finally.

DETAILED DESCRIPTION OF THE INVENTION

Figure 1:
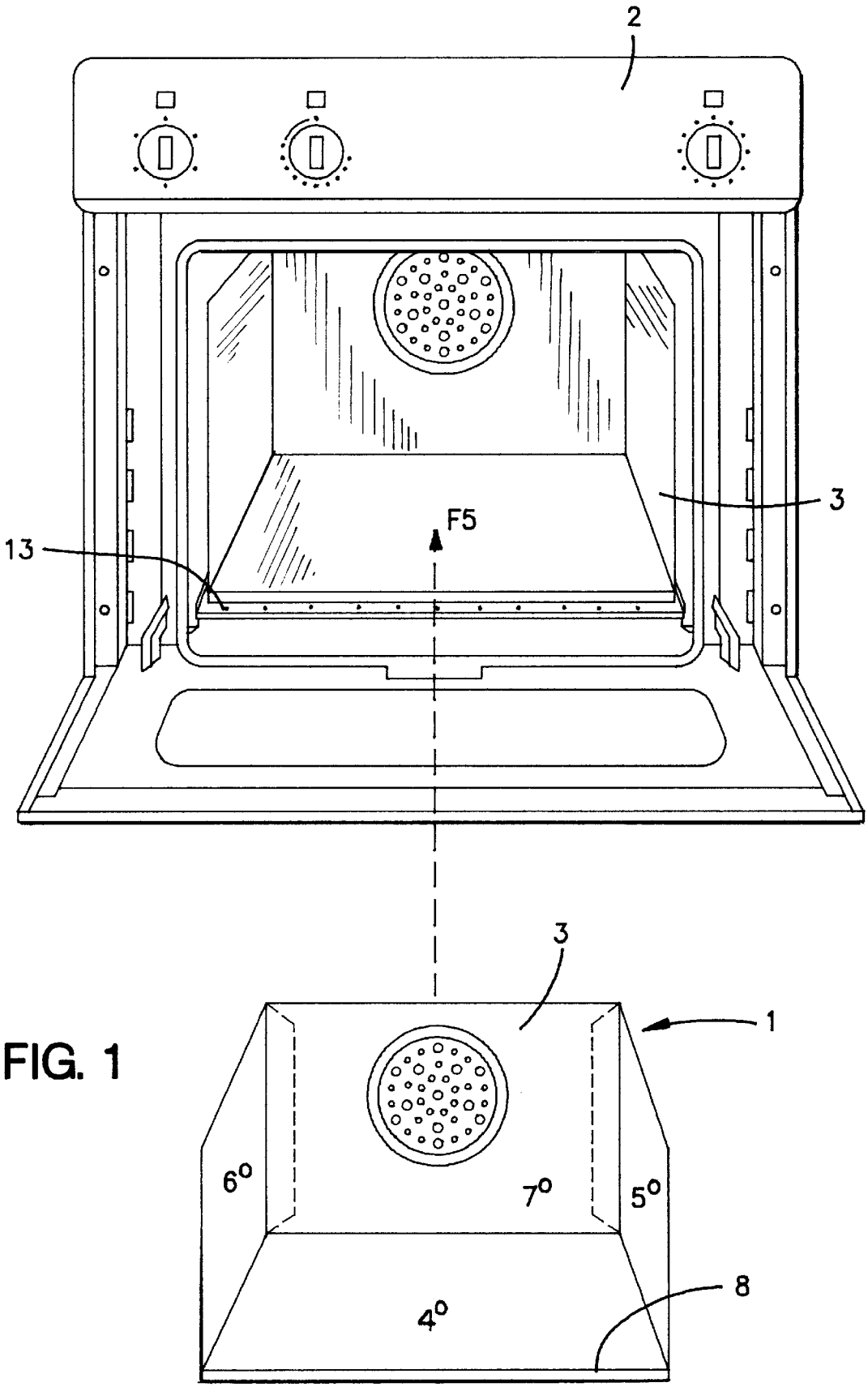
FIG. 1 is a perspective view of an oven whose door is open and receives a protective device according to the invention.

The device according to the invention permits overcoming these drawbacks. It thus comprises, according to a first characteristic, of assembly of interconnected removable walls forming a housing. This housing, in accordance with the dimensions of the oven, receives, during cooking, the projection of grease and sauce. After one or several uses, the housing is replaced by a new housing, keeping the walls of the oven completely clean, which thus permits prolonging the life of the material and effecting substantially economies. The walls of the housing are spaced from the walls of the oven a distance sufficient to permit correct circulation of hot air flow. The bottom of the housing rests on the removable grill of the oven. The upper portion of the housing is not covered, so as not to disturb the radiation of the overhead electrical resistances.

According to particular embodiments:

in a "static" version, the housing is provided, on its rear surface, with a slot permitting the passage of the rod of a spit, in a "hot turning" version, the housing comprises, on its rear surface, a grill-filter for passage of air, so as not to modify the initial characteristics of the oven, the housing is made of different dimensions to adapt to all models of ovens existing on the market, the housing is made of different materials, such as: aluminum, stainless steel, fireproof paper or cloth, raw, aluminized, siliconed or clad with an anti-adhesive material, having regard for the safety and health standards in force, the housing is made in a foldable manner, so as to reduce the volume of the packaging and storage, whilst maintaining a very simple use for the kitchen, according to the materials utilized, the housing can comprise a frame of articulated rods so as to consolidate the assembly, the materials can be fixed to the frame of rods by cementing, welding or sewing, the materials constituting the housing can be microperforated to improve the heat transfer, the housing can comprise, on its forward surface, a small non-spill flange, the folding surfaces of the housing are maintained together either by adhesive, packaging, stapling, lacing or a combination of these processes.

The device comprises a housing comprised of a bottom, two side walls, a rear panel and a non-spill flange. The walls, the panel and the flange are secured to the bottom and articulated relative to the latter.

The assembly of the walls, relative to the rear panel, takes place by two junction flaps provided with an adhesive material.

The rear panel comprises a precut slot provided with a reinforcement for the passage of the rod of a spit in the static version.

In one embodiment, the rear panel comprises a grill-filter for the passage of air, for the "turning heat" version.

In certain embodiments and according to the materials used, the housing is provided with an articulated rod frame.

The non-spill flange is maintained in vertical position by adhesive tongues secured to the walls.

The device according to the invention is particularly adapted for the internal protection of domestic ovens.

The present invention relates to a disposable device 1 for internal protection, adapted to be emplaced, according to F5 of FIG. 1, within the enclosure of an oven 2.

This disposable device 1 is essentially constituted by a foldable housing 3.

Figure 3:
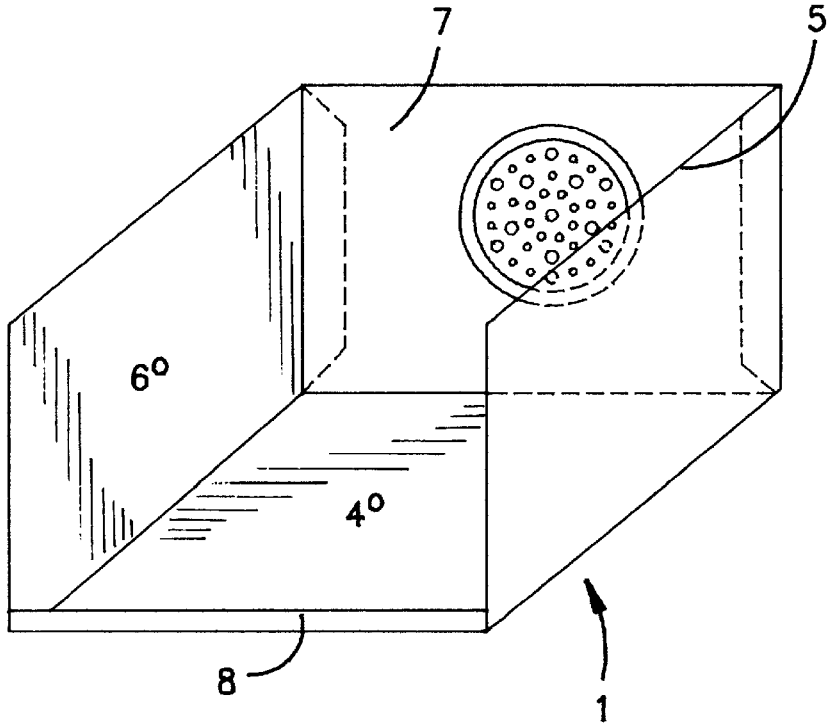
FIG. 3 is a perspective view of the device of FIG. 2, set up.
Figure 8:
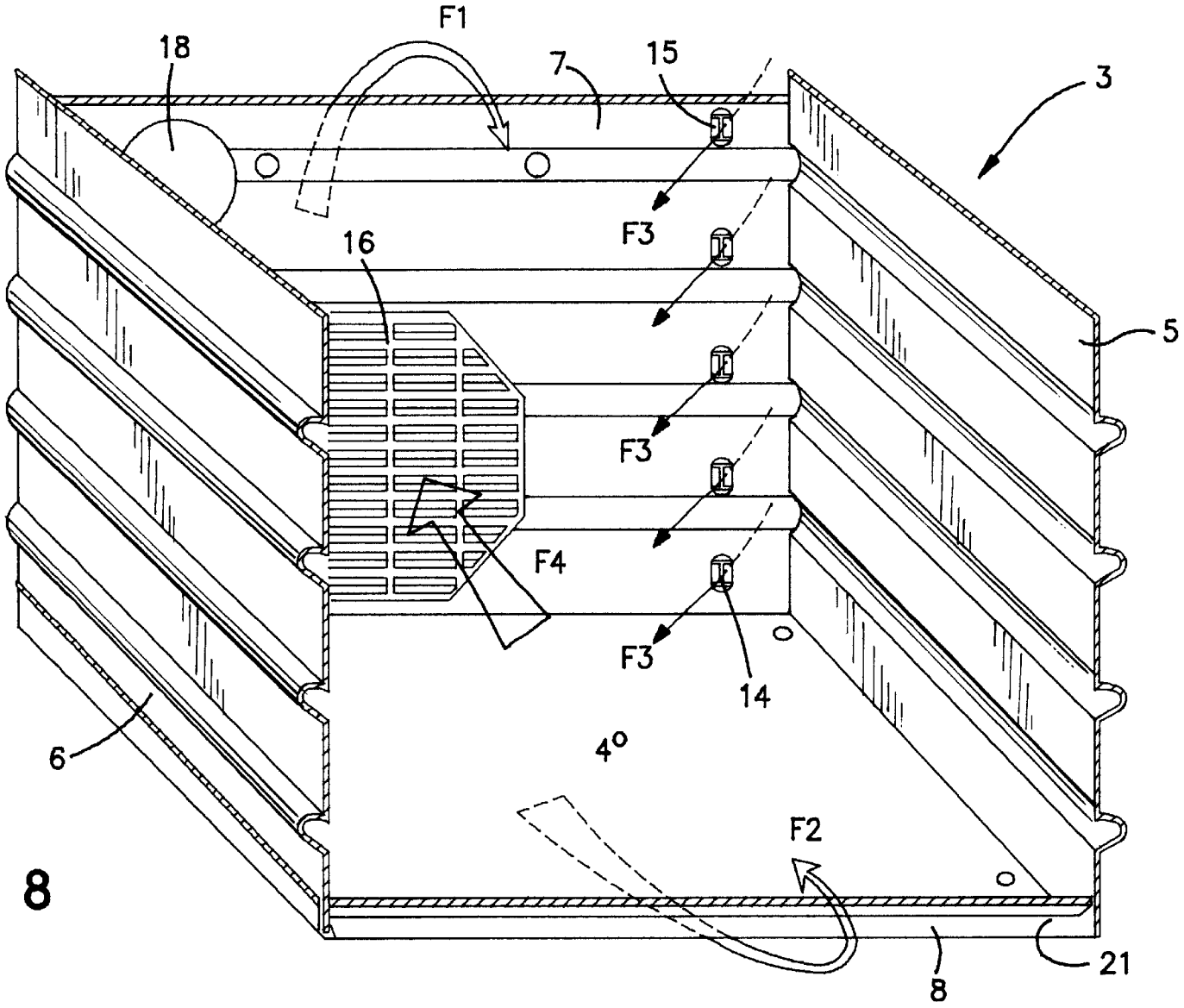
FIG. 8 is a perspective view of another embodiment of the protective device, in which the air movements are shown.
Figure 9:
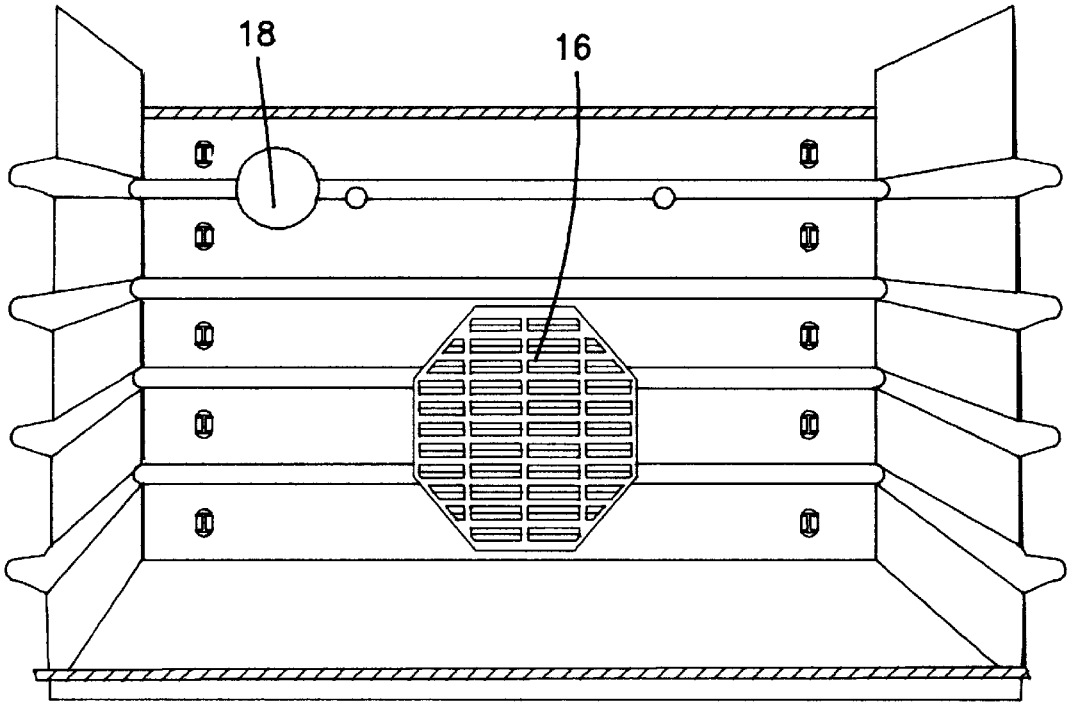
FIG. 9 is a front view of FIG. 8.

This housing 3 is set up, as seen in FIGS. 3, 8 and 9. It has a substantially parallelepipedal shape having two surfaces which have been omitted. These two surfaces are the upper surface and the front surface. Because of this, the housing 3 is constituted by a rear wall 7, two lateral walls 5 and 6 and a lower wall 4.

Figure 2:
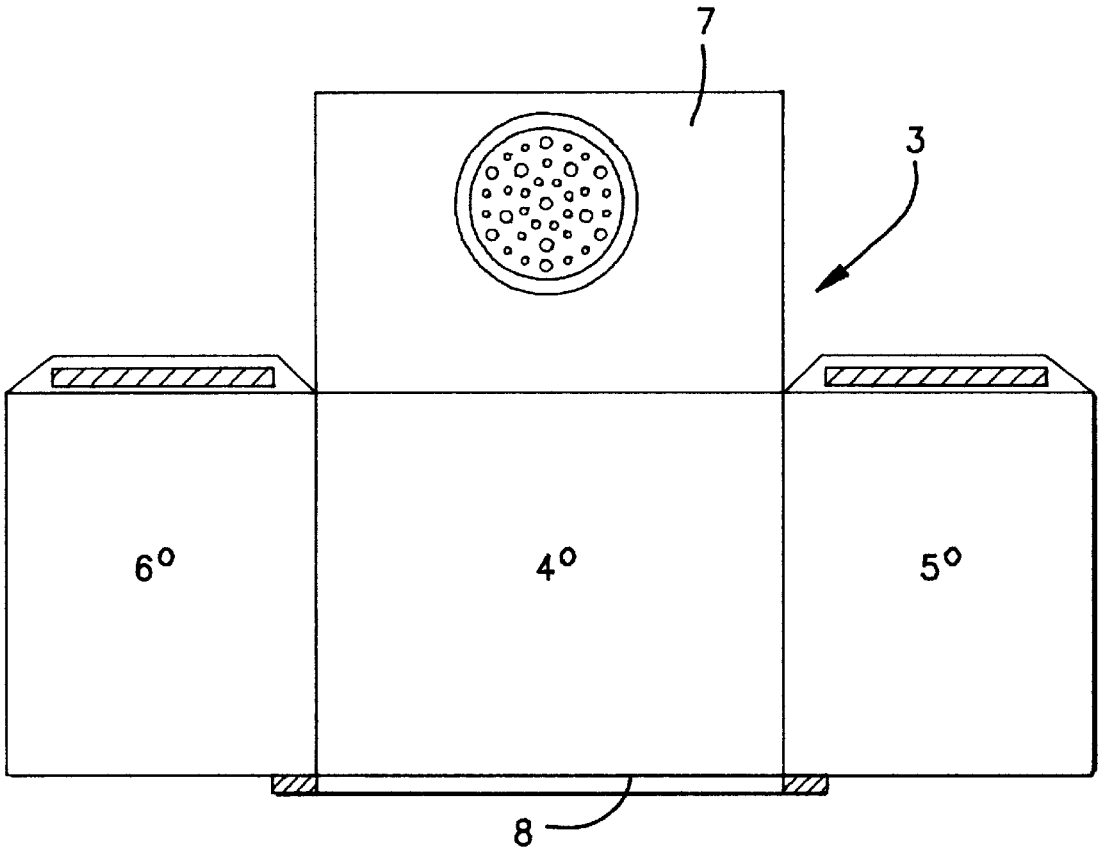
FIG. 2 is a flattened view of the first embodiment of the device according to FIG. 1.

According to a first embodiment shown in FIGS. 1 and 2, these walls are secured together and form a single piece assembly.

Figure 6:
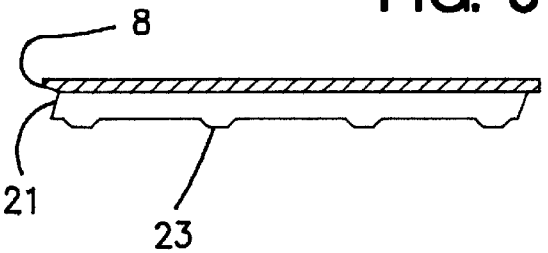
FIG. 6 is a side view of FIG. 5.
Figure 5:
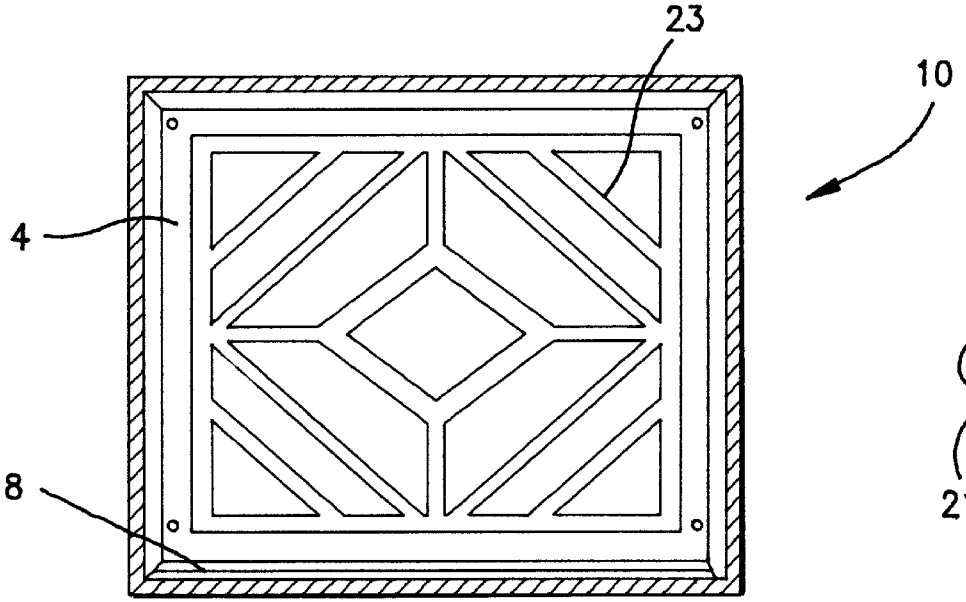
FIG. 5 is a plan view of the second portion of the second embodiment of the device.

According to a second embodiment shown in FIGS. 5 and 6, the foldable housing 3 is constituted by two portions 9 and 10.

Figure 12:
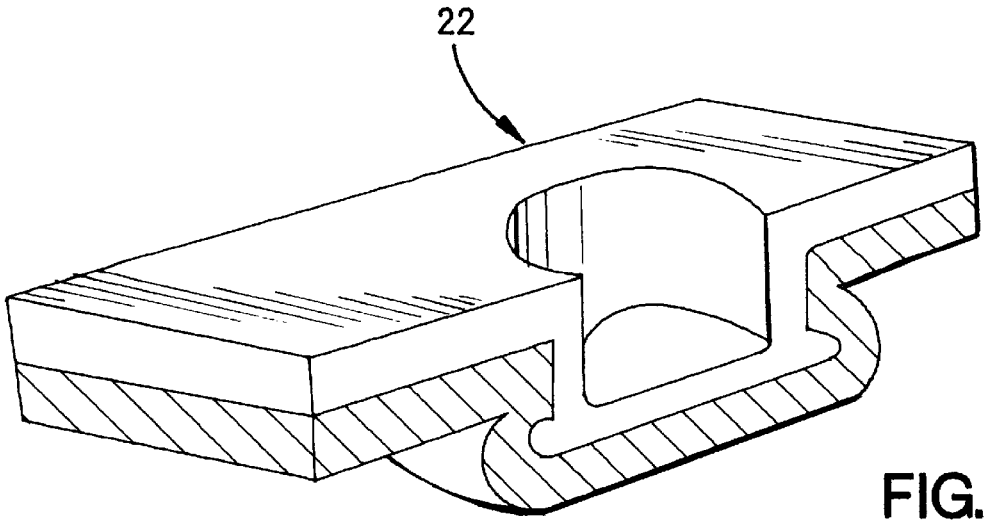
FIG. 12 is a cross-sectional view of a means for securement between the two aluminum sheets.

The first portion 9 is comprised by the assembly, by securement means in the public domain, of three panels constituting on the one hand the side walls 5 and 6 and on the other hand the rear wall 7. This securement can be carried out either by cementing, welding or clinching 22, in the manner shown in FIG. 12.

The second portion is constituted by the lower wall 4 which, as is seen in FIG. 6 in side view, is constituted by a tray 4.

In a particularly interesting embodiment, this tray can be constituted by a flat member which can be reused. In this case, it will be necessary to replace the three other walls of the disposable device 1. Moreover, the use of a flat member, like tray 4, can permit storage during sale of the device 1, of a maximum of first portions 9 constituted by the disposable side walls 5, 6 and rear wall 7.

According to a second embodiment of the first portion 9 of the housing 3, the latter is constituted by a single element folded at two levels to constitute, on the one hand, the rear wall 7, and on the other hand the right side wall 5 and the left side wall 6. This is well shown in FIG. 7. Of course, this second portion will always coact with a second portion 10, as shown in FIGS. 5 and 6.

As is seen in FIGS. 4 to 7, the grooves are present at the level of the assembly of the walls to increase the rigidity of the assembly.

Figure 4:
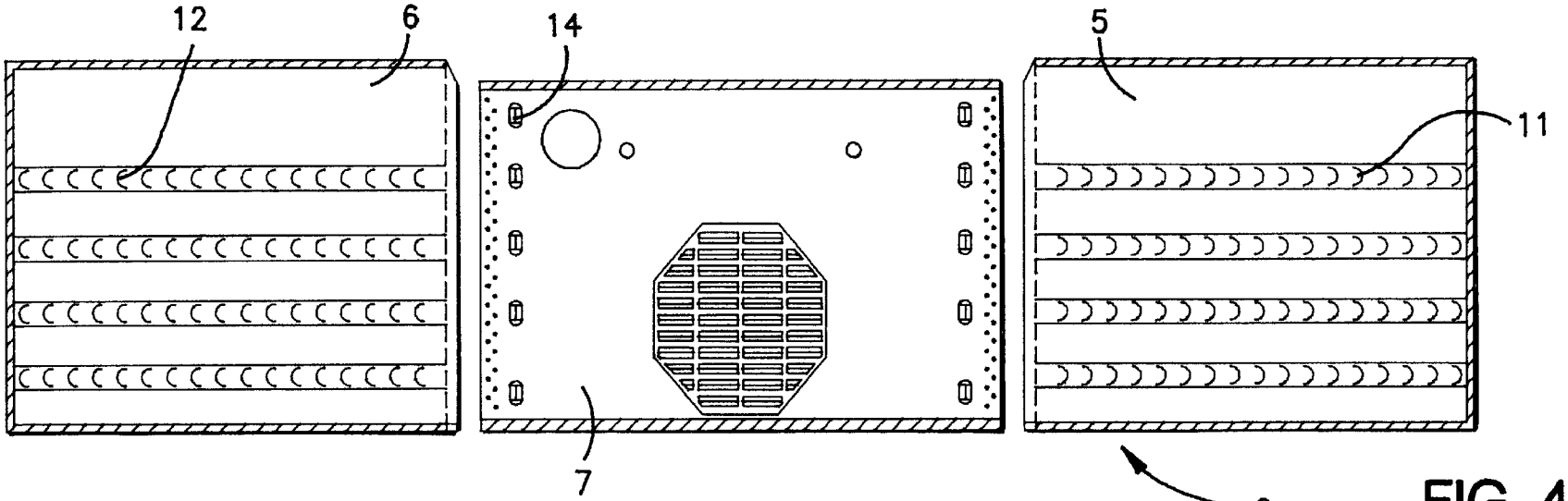
FIG. 4 is a front view, flattened, of the first portion of the second embodiment of the device.

Thus, in FIG. 4, the side walls 5 and 6 comprise horizontal grooves 11 and 12 which are parallel to the tray 4, when the housing 3 is set up. These grooves 11 and 12 permit the emplacement, within the device 1 itself within the oven 2, of a grill 13 for said oven 2, shown in FIG. 1.

In this FIG. 1, the grill 13 is not however emplaced to permit its positioning within the disposable device 1, but below this device 1 so as to create a space between the bottom of the oven 2 and the lower wall 4 of said disposable device 1.

The tray 4 according to FIGS. 5 and 6 also comprises ribs 23 which increase the rigidity of this member.

Figure 7:
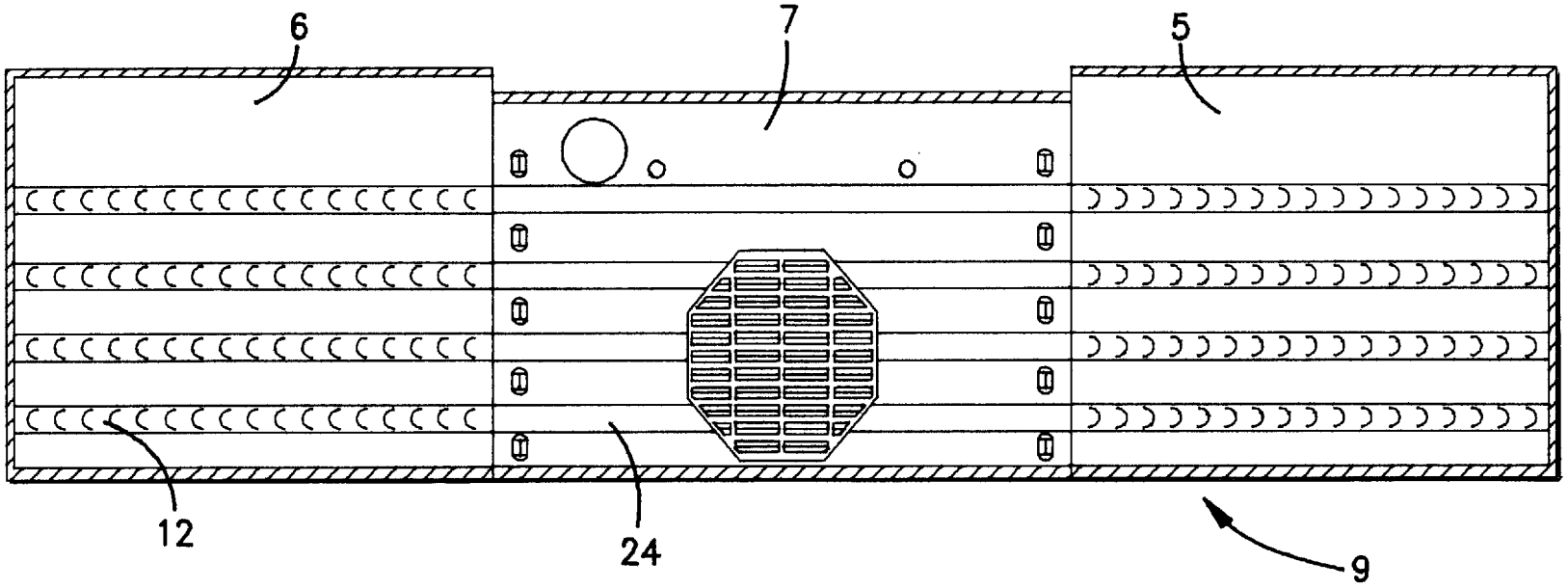
FIG. 7 is identical to FIG. 5 but relates to a modified embodiment of the second portion.

According to FIG. 7, the rear wall 7 being integrated structurally with the side walls 5 and 6, it is necessary that the surplus of material due to the presence of the grooves 12, at the level of the side walls 5 and 6, be resorbed. Because of this, there are provided folds 24 which permit absorbing these side grooves 12 and further increasing the rigidity of the rear wall 7.

The assembly of the walls 4 to 7 always comprises the same references, so as to facilitate the understanding of the different embodiments of the present invention.

At the level of the front surface, there is in fact the presence of a small non-spill flange 8 seen in FIGS. 1 to 10.

As will also be seen in FIG. 6, this non-spill flange 8 has a V shape 21, in transverse cross section. This permits improving the rigidity of this flange 8 and also to give it the function of a cross piece between the two side walls 5 and 6.

In all of the figures, it will be noted that the rear wall 7 is provided with a grill-filter 16. The latter has a quite particular structure shown in FIG. 11 and which is constituted by an assembly of overhangs 17.

Figure 11:
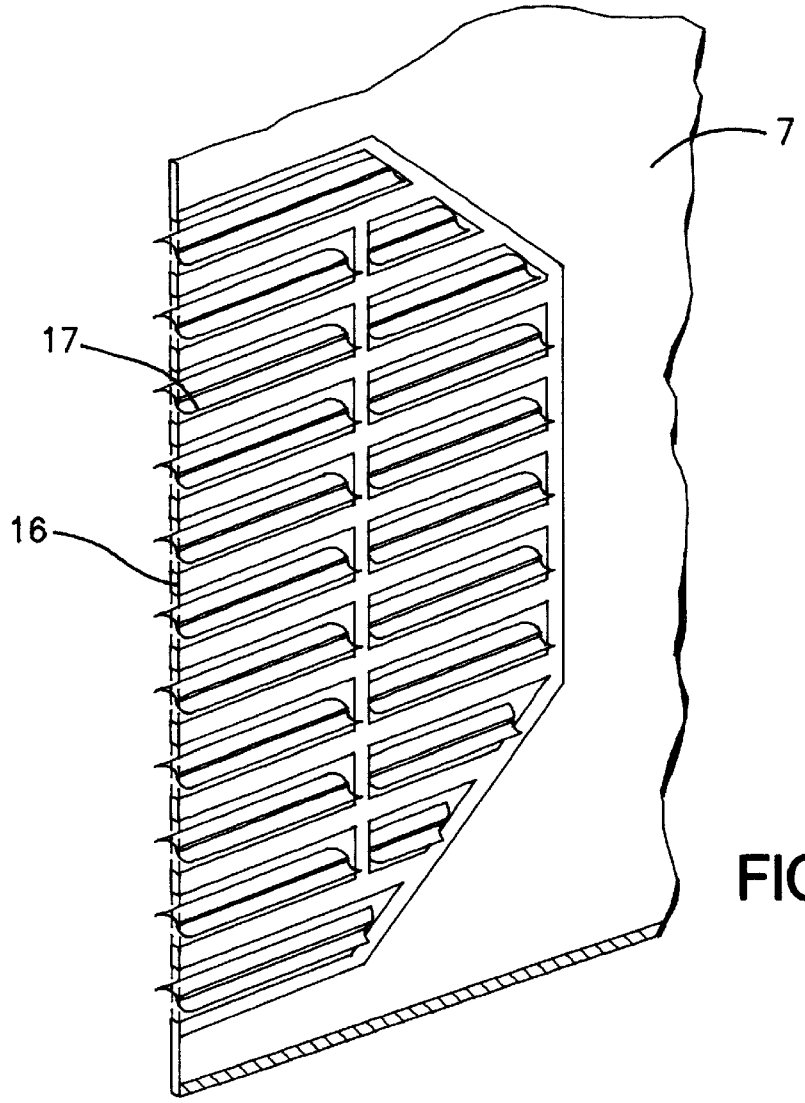
FIG. 11 is a sagittal cross section of a grill-filter.

In this FIG. 11, the front portion of the plane is that which is located within the disposable device 1. It is hence easy to understand that all liquid or liquid cooking substance which will flow along the internal surface of the rear wall 7 cannot pass to the outside of said disposable device 1 because the inclination of the overhangs 17 avoids the external flow of said fluid.

Although not shown in the drawings, it is possible that the walls 4 to 7 comprise, at a predetermined suitable position, a slot permitting the emplacement of the spit of the oven 2.

According to FIGS. 4, 7, 8 and 9, there will be noted the presence at the level of the rear wall 7 of a transparent portion 18 whose predetermined position is suitable to permit the juxtaposition relative to the internal lamp of the oven 2.

According to FIG. 8, it is possible to visualize all of the movements of air which can take place within the disposable device 1. It is in this connection that will be seen the novelty and importance of the invention relative to the state of the art.

It will be noted that the hot air can, by convection, penetrate to the interior of the concavity of the disposable device 1 at the level of three very precise locations.

First, according to F1, the hot air can penetrate while passing above the rear wall 7.

Then according to F2, the hot air can also pass between the lower wall 4 and the bottom of the oven. Of course, it will be necessary that there always exists a space between these two partitions to avoid any overheating or other problem.

Finally, according to F3, a plurality of holes 14 at the level of the wall 7 is provided; of course, these holes 14 could be located at another place or in another wall.

Finally, there exists an aspiration to counter this convectional movement according to F1, F2 and F3. This aspiration according to F4 takes place through the grill-filter 16 which also serves as suction means because this grill-filter 16 is placed facing the original suction source present at the level of the oven 2. These holes 14 are thus provided by a cutout having an H shape, which creates two adjacent wings 15. These two wings 15 are partly open and extend to within the disposable device 1 such that it creates substantially a venturi having a function as an air projection nozzle in the direction F3.

Figure 10:
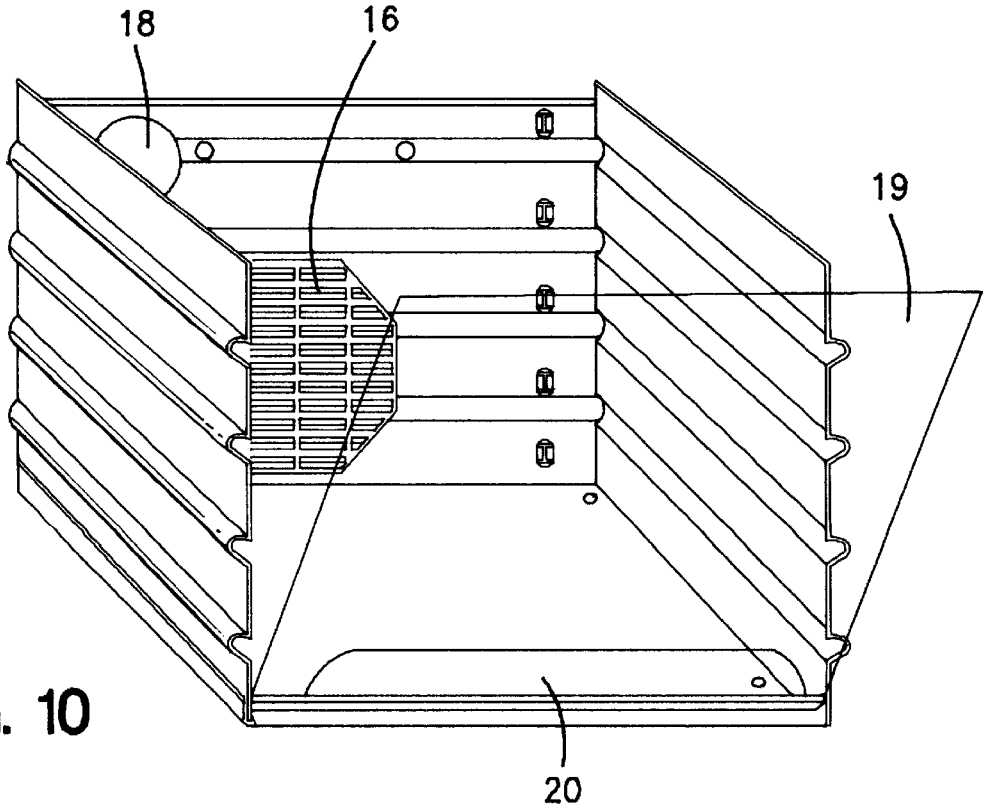
FIG. 10 is a modified embodiment of the base of the device of FIG. 8.

According to FIG. 10, the housing 3 can if desired comprise a transparent front wall 19. Nevertheless, it is necessary that the air flow according to F2 can always be carried out, and because of this, a free space 20, located between the flange 8 and the wall 19, exists.

REFERENCES

1. Disposable device for internal protection
2. Domestic oven
3. Foldable housing
4. Lower wall or tray
5. Right side wall
6. Left side wall
7. Rear wall
8. Non-spill flange
9. First portion of housing 3
10. Second portion of housing 3
11. Horizontal grooves in wall 5
12. Horizontal grooves in wall 6
13. Grill of the oven 2
14. Holes through the wall 7
15. Adjacent ribs of the hole 14
16. Suction means or grill-filter
17. Overhangs of the grill-filter 16
18. Transparent portion of the wall 7
19. Front transparent wall
20. Free space between the flange 8 and the wall 19
21. V-shape of the flange 8
22. Means for clinching the two walls
23. Rib for wall 4
24. folding of wall 7

F1. Arrival of air from below into the device 1

F2. Arrival of air through the front of the device 1

F3. Arrival of air through the holes 14

F4. Suction of air through the grill-filter 16

F5. Introduction of the device 1 into the oven 2

I claim:

1. A disposable device for the internal protection of domestic ovens, comprising:

a foldable box having an open top;

said box including a lower wall, two side walls, and a rear wall having an upper edge;

said lower wall including a non-spill flange which comprises a front edge of said lower wall;

said device further comprising a first convective air inlet over said upper edge, a second convective air inlet adjacent said front edge, and a plurality of third convective air inlet holes extending through said rear wall;

said rear wall further comprising an air outlet structured and arranged to align with a suction source of an oven.

2. The device according to claim 1, wherein the folding box is a one-piece construction.

3. The device according to claim 1, wherein the folding box is a two-part construction, a first part comprised of the two side walls and the rear wall, and a second part comprised of the lower wall and the non-spill flange.

4. The device according to claim 3, wherein the second part is constituted by a tray which serves as the lower wall, said tray having an edge which serves as the non-spill flange.

5. The device according to claim 1, wherein the walls of the foldable box are constituted by aluminum sheets.

6. The device according to claim 1, wherein the walls of the foldable box are constituted of cloth and/or paper, and each wall comprises a core constituted by a frame.

7. The device according to claim 1, wherein the side walls comprise horizontal grooves, each groove of one of the side walls being at the same level as an opposite groove of the other side wall, such that at least one oven grill can be emplaced in a pair of vertically aligned opposite grooves.

8. The device according to claim 1, wherein each hole is formed by a cutout of H shape, which creates two ribs whose deformations constitute an air projection nozzle.

9. The device according to claim 1, wherein the air outlet on the rear wall includes a grill-filter.

10. The device according to claim 9, wherein the grill-filter comprises a grill having overhangs which prevents liquids from flowing on an external surface of the rear wall.

11. The device according to claim 1, wherein the folding box comprises at least one slot for the passage of a spit rod.

12. The device according to claim 1, wherein a portion of at least one of the walls, vertically aligned with an internal illumination of the oven, is transparent and heat resistant.

13. The device according to claim 1, further comprising a front transparent wall having a lower edge which defines between said lower edge and the non-spill flange, a free space for air circulation.

14. The device according to claim 1, wherein the non-spill flange is of V shape, in transverse cross section.

* * * * *